US005177936A

United States Patent [19]

Myers et al.

[11] Patent Number: 5,177,936

[45] Date of Patent: Jan. 12, 1993

[54] MACHINE AND METHOD FOR LOADING A CASSETTE INTO A SECURITY PACKAGE

[75] Inventors: David L. Myers, Bolivar; Bruce M. Rothacher, Dover; Gale W. Essick, E. Canton; David J. Dillon, Canton, all of Ohio

[73] Assignee: Alpha Enterprises, Inc., East Canton, Ohio

[21] Appl. No.: 792,180

[22] Filed: Nov. 14, 1991

[51] Int. Cl.[5] ..... B65B 5/04; B65B 7/26

[52] U.S. Cl. ..... 53/467; 53/473; 53/484; 53/250; 53/377.6

[58] Field of Search ..... 53/467, 473, 484, 249, 53/250, 252, 377.6, 377.3, 474, 491

[56] References Cited

U.S. PATENT DOCUMENTS

| | | | |
|---|---|---|---|
| 3,543,476 | 12/1970 | Jaroff et al. | 53/250 X |
| 4,594,837 | 6/1986 | Zielke | 53/252 X |
| 4,612,752 | 9/1986 | Deal | 53/377.6 X |
| 4,672,797 | 6/1987 | Hagler | 53/377.6 X |
| 4,685,277 | 8/1987 | Ilsemann | 53/474 |
| 4,709,535 | 12/1987 | Mahaffy et al. | 53/473 |
| 4,834,238 | 5/1989 | Hehn et al. | 206/387 |
| 4,865,190 | 9/1989 | Gregerson et al. | 206/309 |

*Primary Examiner*—Horace M. Culver
*Attorney, Agent, or Firm*—Michael Sand Co.

[57] ABSTRACT

A machine and method for automatically loading a cassette into the storage compartment of a security package at a load station. A package and a cassette are moved simultaneously toward each other from a supply of such packages and cassettes by power actuated slide plates with the cassette being located above the level of the package. In a first embodiment a pivotally mounted pressure actuated cam plate forces a front end of the cassette in an angular direction partially into the storage compartment and then force the remainder of the cassette completely into the storage compartment as the slide plate continues to move the package toward the load station. In a second embodiment the slide plate moves the cassette along a cam plate and partially into the storage compartment, afterwhich, a pressure actuated plunger forces the remainder of the cassette into the storage compartment. A locking mechanism including pressure actuated cams, then moves the security package lock plate from an unfolded position into a locked position to retain the cassette in the storage compartment.

19 Claims, 18 Drawing Sheets

MACHINE AND METHOD FOR LOADING A CASSETTE INTO A SECURITY PACKAGE

BACKGROUND OF THE INVENTION

1. Technical Field

The invention relates to a machine and related method for automatically loading a cassette into a security package. More particularly, the invention relates to a machine and method which brings a audiocassette and a security package from separate supplies of said cassettes and packages to a work station whereat the cassette is automatically loaded into the storage compartment of the security package and a lock plate automatically moved to a locked position to retain the cassette within the security package.

2. Background Information

In recent years, audiocassettes have become increasingly popular and outsell the heretofore LP record discs and 8-track audio tapes. The introduction of these cassettes into the audio market presented a problem to the retail sellers in that the cassettes, which are smaller than the heretofore used 8-track tapes and record discs, had to be displayed so that perspective purchasers could inspect the tape to determine the artist, songs etc. on the cassettes. This presented a security problem due to the extremely small size of the audiocassettes and ease of shoplifting.

Therefore, to reduce this shoplifting problem, the cassettes were placed in larger security packages of the type shown in U.S. Pat. Nos. 4,384,238, 4,865,190.

Although these security packages perform satisfactorily, they do require the retailer and usually the wholesaler, to place the cassettes into the storage compartment of the security package and then lock the security package in a locked position. Heretofore, this was accomplished manually by work personnel which increased the cost of the final distributed product, especially since these audio tapes are sold and packaged in the millions.

It is also desirable that such security packages be of the reusable type wherein the locked plate of the particular locking mechanism can be moved to an unlocked position by a manually operated key or the like.

There is no known machine or method for automatically loading cassettes into security packages of which we are aware which will move the cassettes and security packages from a supply of such cassettes and security packages to a load station wherein the cassette is automatically loaded into the security package and the package placed in a locked position and then discharged for subsequent packaging and shipment.

SUMMARY OF THE INVENTION

Objectives of the invention include providing an improved machine and associated method for automatically loading a cassette, and in particular an audiocassette, into a security package and for moving the locking mechanism of the security package from an unlocked to a locked position.

A still further objective of the invention is to provide such a machine which has two separate supply magazines containing a plurality of the cassettes and security packages which are moved by automatic transfer mechanisms to a load station wherein a cassette is automatically inserted into the storage compartment of the security package, afterwhich a lock plate which is hingedly mounted on the cassette, is moved from an unlocked position to a fully locked position with a minimum amount of moving parts and power operated components.

Another objective of the invention is to provide such a loading machine and method in which the security package and cassette are moved from the load station to a locking station by a power actuated slide mechanism for subsequent movement of the locking plate into locked position by power actuated cams.

A still further objective is to provide such a machine which has a relatively simple construction, which achieves the stated objectives in a simple, effective, and inexpensive manner and which solves problems and satisfies needs in the art.

These and other objectives and advantages of the invention are obtained by the loading machine of the present invention for automatically loading a cassette into a security package of the type having a storage compartment and an access opening providing access into the storage compartment and further having a lock plate movable over the access opening and into a locked position to block removal of the cassette from the storage compartment, the general nature of such machine may be stated as including a load station; first slide means for moving a security package from a supply of said packages to the load station; second slide means for moving a cassette from a supply of said cassettes to the load station; load means for initially moving a first end of the cassette in an angular direction through the access opening of the package and partially into the storage compartment, and then subsequently moving a second end of the cassette into the storage compartment to fully seat the cassette therein; and lock means for moving the lock plate into the locked position over at least a part of the access opening.

These objectives and advantages are further obtained by the improved method of the present invention, the general nature which may be stated as including a method for loading a cassette into a security package of the type having a storage compartment and an access opening providing access into the storage compartment and a lock plate for blocking removal of the cassette from the storage compartment, the general nature of said method may be stated as including the steps of moving a security package from a supply of said packages toward a load station; moving a cassette from a supply of said cassettes toward the load station; moving a first end of the cassette through the access opening and partially into the storage compartment of the security package; and then moving a second end of the cassette completely within the storage compartment to fully seat the cassette therein; and then moving the lock plate from an unlocked position to a locked position.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 2:
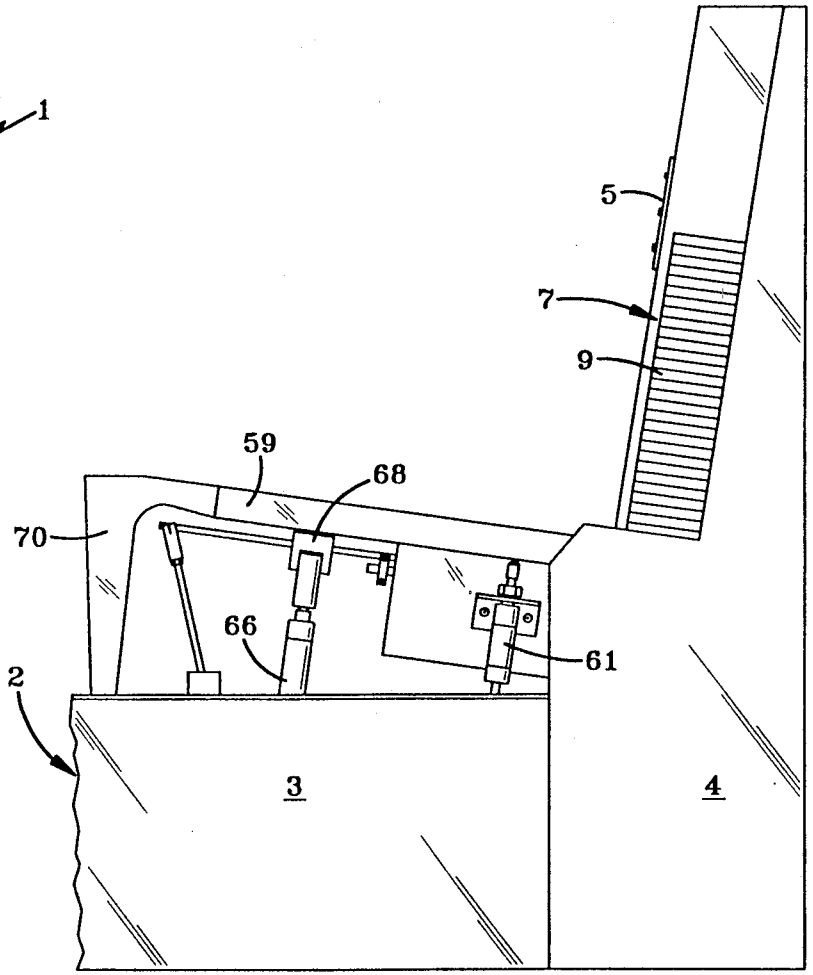
FIG. 2 is a generally diagrammatic fragmentary side elevational view of the machine as shown in FIG. 1.
Figure 1:
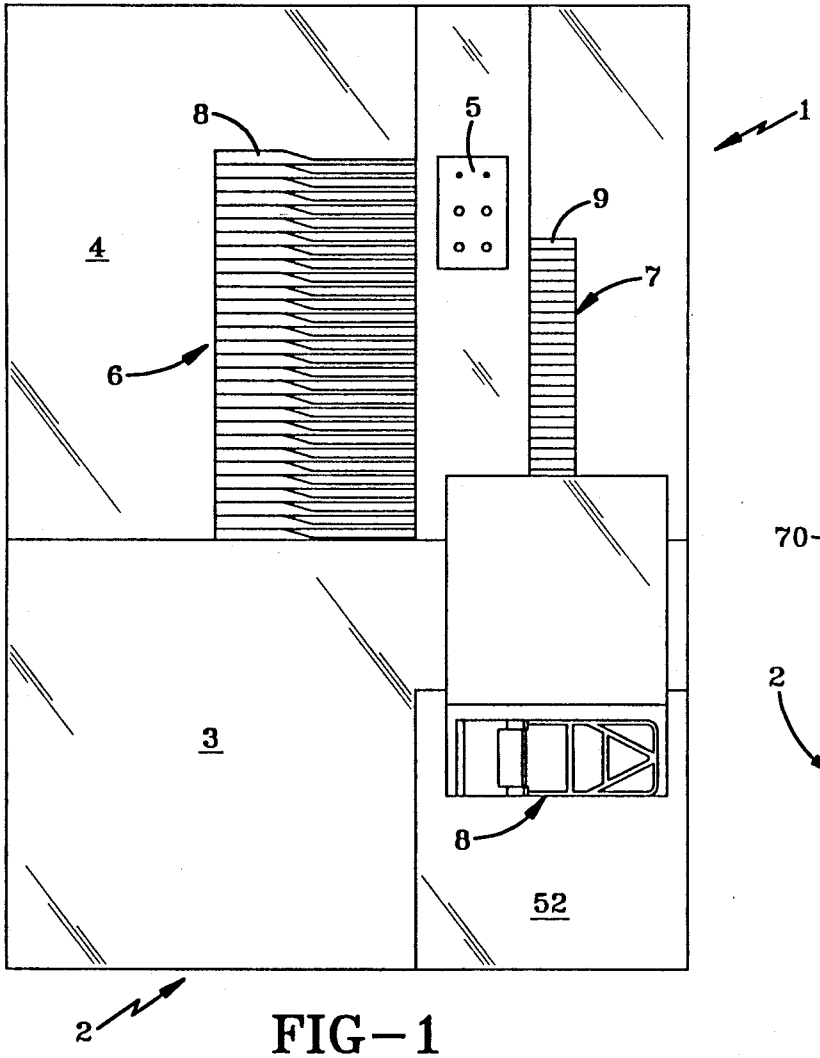
FIG. 1 is a generally diagrammatic front view of a first embodiment of the automatic loading machine of the present invention.

The loading machine of the present invention is indicated generally at 1, and is shown particularly in FIGS. 1 and 2. Machine 1 includes a usual support cabinet 2 which includes a base 3 and a vertically extending rear portion 4 and a front control panel 5. Rear portion 4 is formed with a pair of supply magazines 6 and 7 for holding a plurality of security packages 8 and audio cassettes 9 respectively, in a vertically stacked condition. Security packages 8 are usual one-piece molded plastic members such as shown in U.S. Pat. Nos. 4,834,238 and 4,865,190, the contents of which are incorporated herein by reference. The particular cassettes 9 described herein and shown in the drawings are of the type shown in U.S. Pat. No. 4,834,238, and is adapted to contain a usual plastic storage case which contains the audio tape, the construction of which is well known in the art and is shown in U.S. Pat. No. 4,834,238. Magazines 6 and 7 preferably retain the supply of security packages 8 and cassettes 9 in a slightly inclined position as shown particularly in FIG. 2, to eliminate the need of front retaining braces and panels for retaining the supply of packages and cassettes in the magazine.

In accordance with one of the features of the invention, a pair of slide assemblies indicated generally at 11 and 12 respectively, are formed on base 3 adjacent rear portion 4 of cabinet 2, and are shown particularly in FIGS. 3–8. Package slide assembly 11 includes a pair of spaced L-shaped slide channels 13 having a spacing therebetween generally equal to the width of a security package 8. Assembly 11 is positioned vertically below package supply magazine 6 so as to receive by gravity, a security package 8 between channels 13 for slidably supporting the same thereon.

Figure 3:
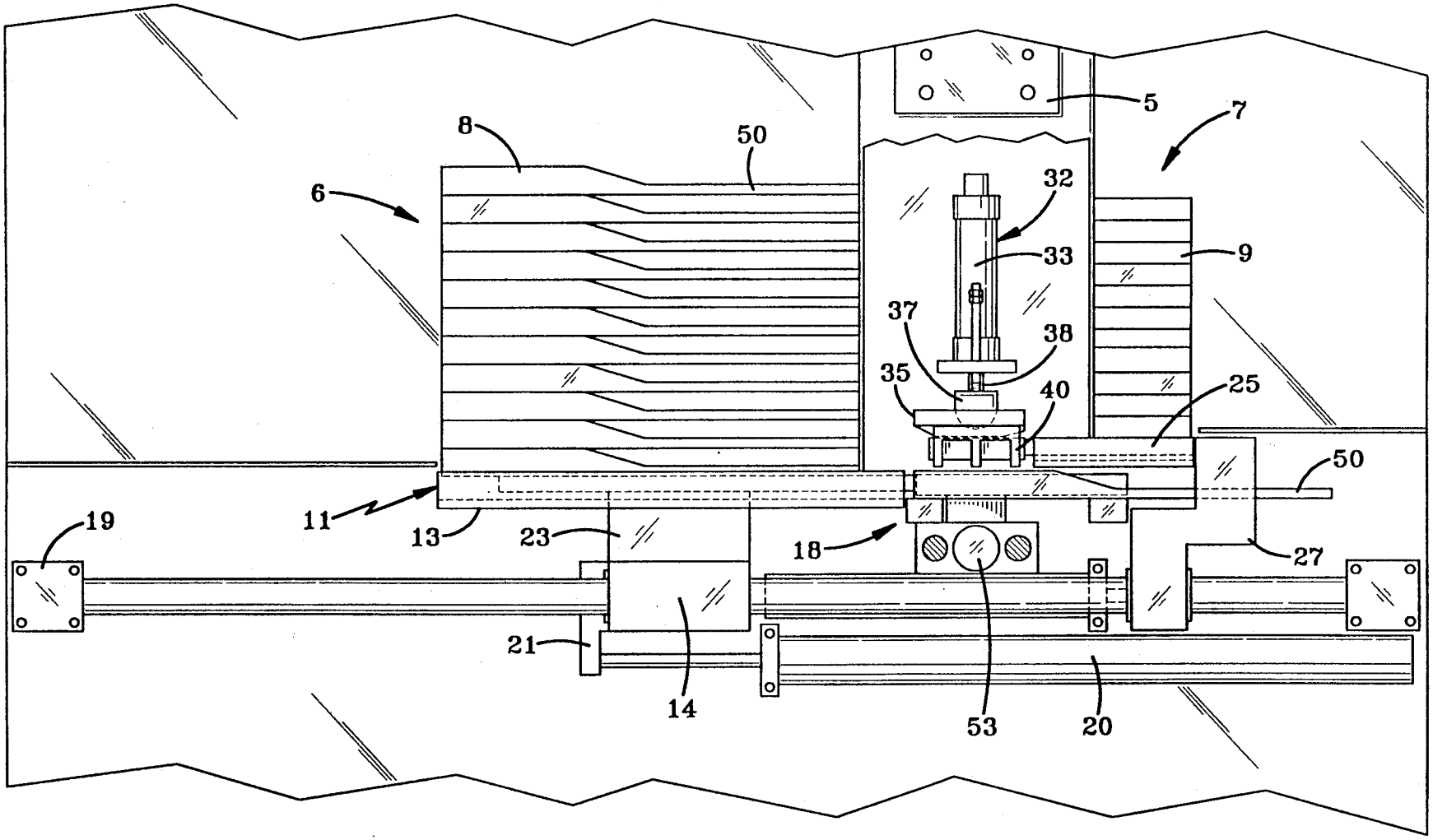
FIG. 3 is an enlarged fragmentary front elevational view of the load station and of the supply magazines containing a plurality of the security packages and cassettes.

A slide or pusher plate 15 is mounted for horizontal sliding movement between slide channels 13 by a pair of bearings 14 on a pair of stationary slide rods 17. Rods 17 extend horizontally along base 3 and beneath a work station indicated generally at 18, and are secured within support cabinet 1 by end mounting brackets 19. As shown in FIG. 3, a stationary pressure actuated, preferably pneumatic cylinder 20, is mounted beneath slide rods 17 and is connected to slide plate 15 by an end bracket 21, which is connected to the extended end of a piston rod 22 of cylinder 20, and then to a connecting plate 23 which is secured to the bottom of plate 15. Actuation of pressure cylinder 20 will move slide plate 15 along and inbetween slide channels 13, and will push a security package 8 located therebetween, as shown particularly in FIGS. 5 and 6, from the security package pickup position beneath magazine 6 to the load station as shown in FIGS. 1–8.

Cassette slide assembly 12 includes a similar pair of L-shaped slide channels 25 which extend in a horizontal plane at an opposite end of load station 18 from that of slide channels 13, for receiving a cassette 9 therein. A slide or pusher plate 26 similar to plate 15, is slidably mounted between slide channels 25 by a step shaped bracket 27 (FIGS. 3–8). Plate 26 is slidably mounted on slide rods 17 by sleeve bearings 31 which are mounted in bracket 27, and is moved along rods 17 by a pressure actuated, preferably pneumatic cylinder 29, which is mounted between slide rods 17 and is connected by piston rod 30 to bracket 27. Thus, upon actuation of the cylinder 29, piston rod 30 and bracket 27 will move slide plate 26 from the cassette pickup position beneath supply magazine 7 to the load station or load position of FIGS. 6–8.

In further accordance with the invention, a load mechanism indicated generally at 32, is mounted at load station 18. Mechanism 32 includes a cassette load cylinder 33 which is mounted by a bracket 34 in a fixed position above the path of movement of the security package and cassette. A pressure plate 35 is pivotally mounted by pivot pin 36, on the bottom of a curved support plate 37, which is attached to the extended end of piston rod 38 of cylinder 33 (FIG. 9), the function of which is described in greater detail below.

Figure 9:
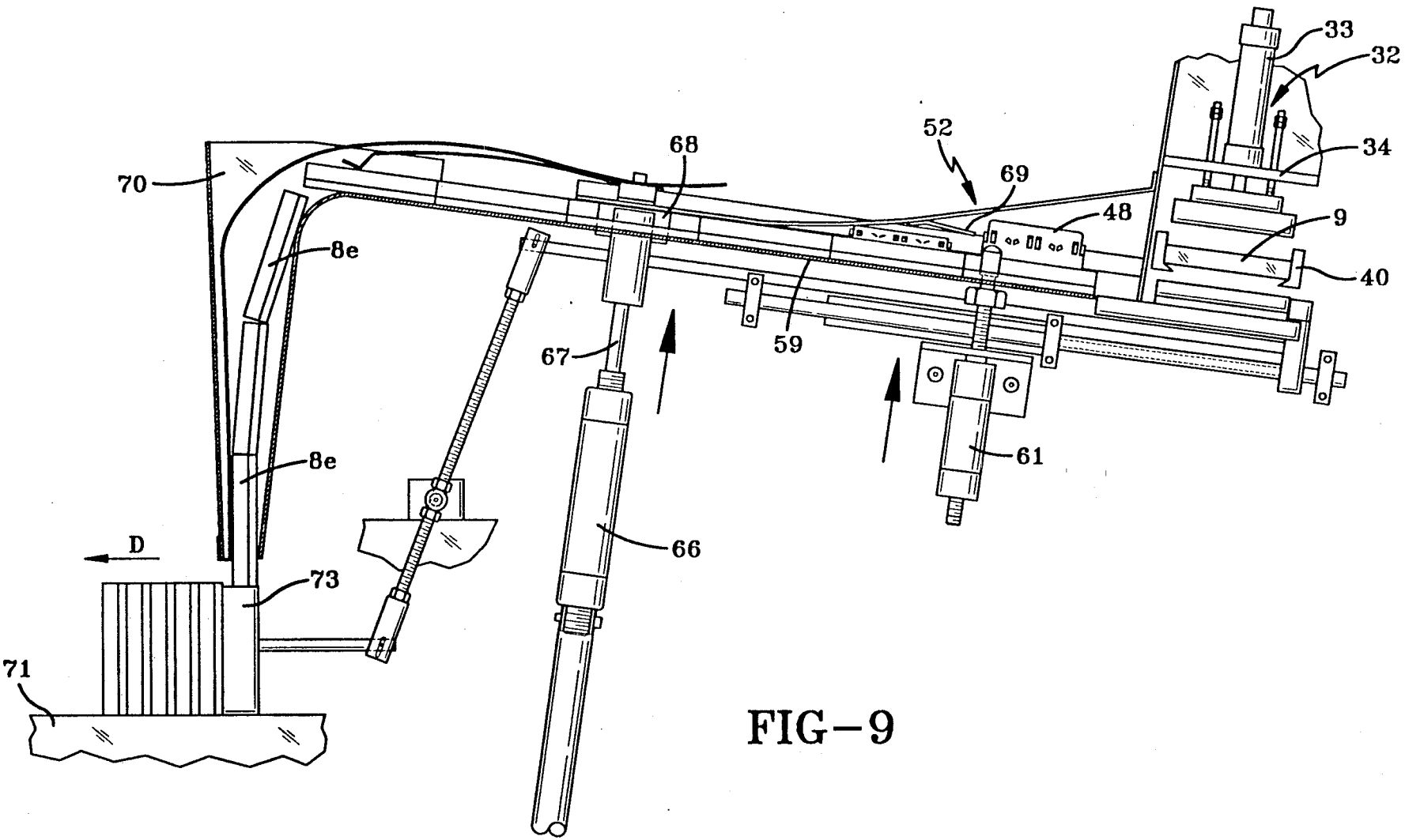
FIG. 9 is a diagrammatic fragmentary side elevational view of the load station, lock station and discharge station of the improved loading machine in a first position.
Figure 10:
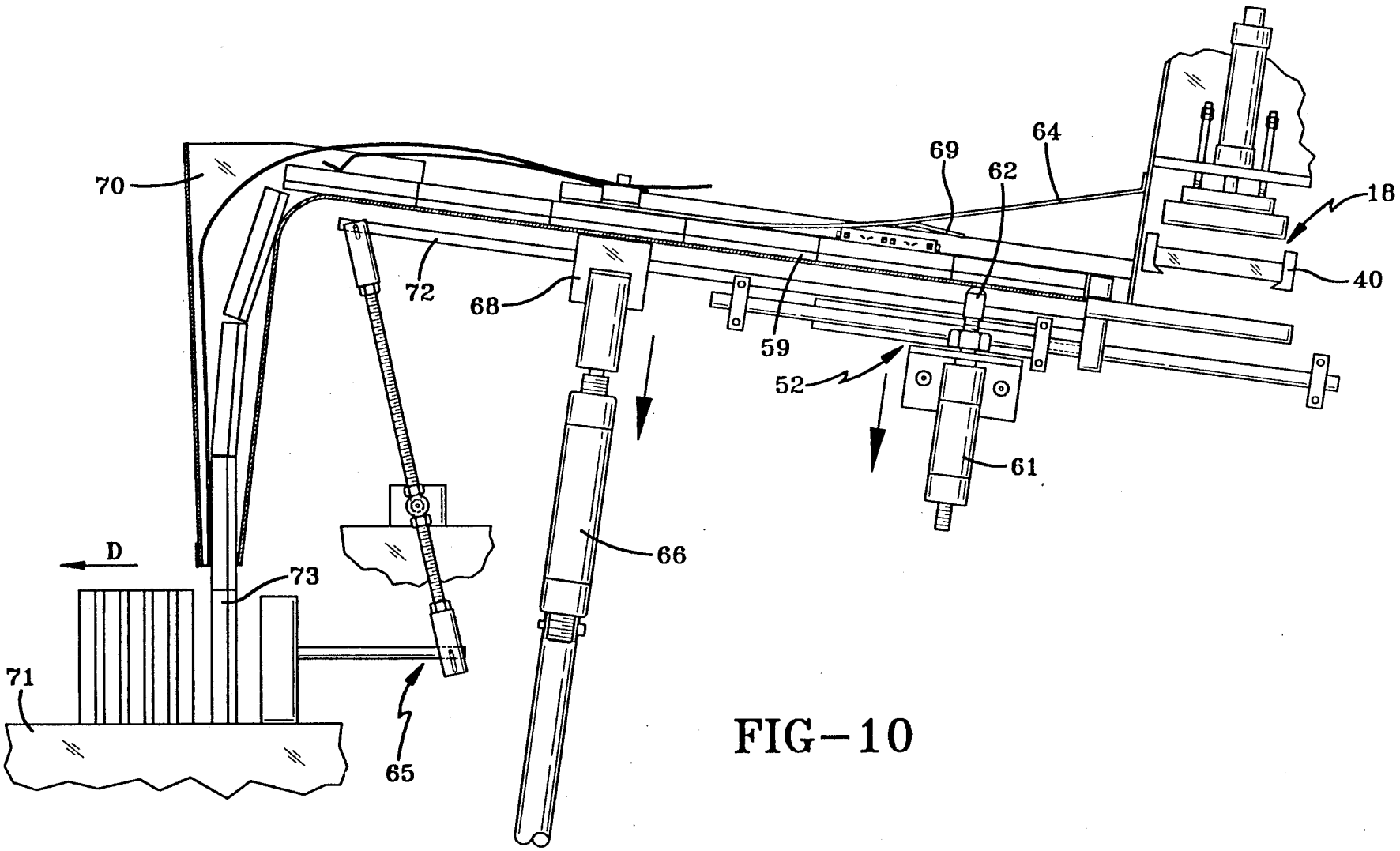
FIG. 10 is a view similar to FIG. 9 showing the components of FIG. 9 in a second position.

A plurality of flexible spaced fingers 40 are mounted at load station 18 in horizontal alignment with slide channels 25 to slidably support a cassette 9 therein, as shown particularly in FIGS. 3, 9 and 10, when moved into position by slide plate 26.

The operation of slide assemblies 11 and 12 and load mechanism 38 is best understood by reference to FIGS. 3–8. A security package 8 and cassette 9 are automatically placed by gravity from their respective magazines 6 and 7, between slide channels 13 and 25, with slide plates 15 and 26 being in a retracted position, as shown particularly in FIG. 5. Actuation of cylinders 20 and 29 according to a programmed sequence, will cause plates 15 and 26 to move toward load station 18 as shown by arrows A in FIG. 6. This will move security package 8 and cassette 9 along their respective slide channels to the position of FIG. 6, wherein package 8 is located beneath load mechanism 32 and cassette 9 is suspended thereabove by flexible fingers 40. Package slide assembly 11 is in a generally horizontal plane below the horizontal plane of cassette slide assembly 12 so that cassette 9 is above package 8 to enable it to be automatically inserted into a storage compartment 41 thereof through a top access opening 42 which has a size and configuration generally complementary to the size and configuration of cassette 9 as described more fully in the above reference U.S. Pat. No. 4,834,238. The sequence of operation is programmed so that cassette 9 is suspended between flexible finger 40 prior to the complete arrival of security package 8 at the load station.

Figure 7:
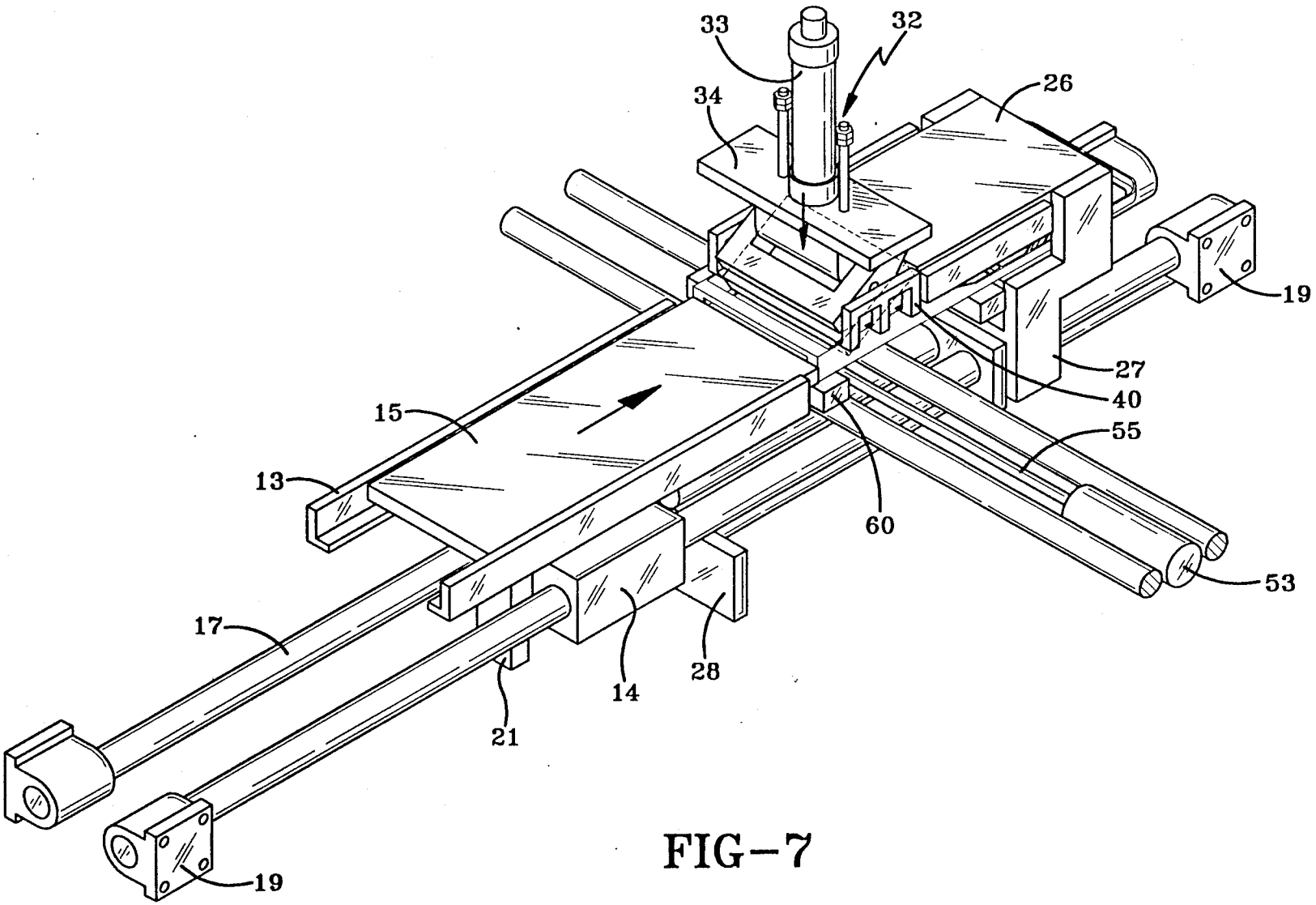
FIG. 7 is a perspective view similar to FIGS. 5 and 6 showing movement of the front end of a cassette partially into the storage compartment of the security container at the load station.
Figure 7A:
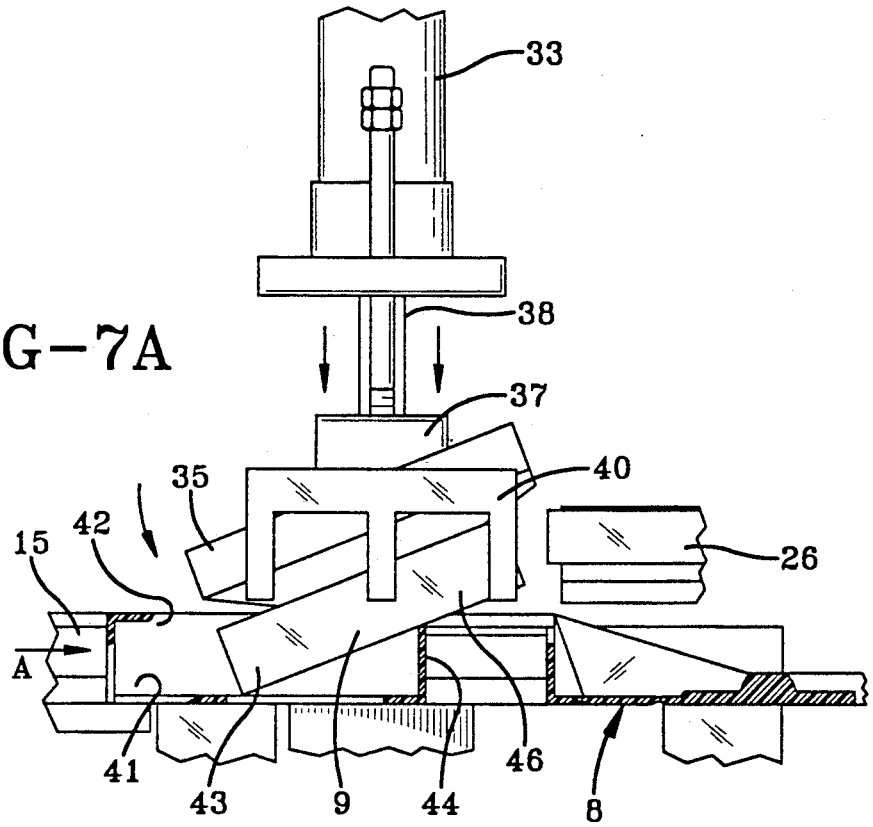
FIGS. 7A and 7B are diagrammatic fragmentary sectional views showing the cassette being automatically loaded into the storage compartment of the security package at the load station.
Figure 7B:
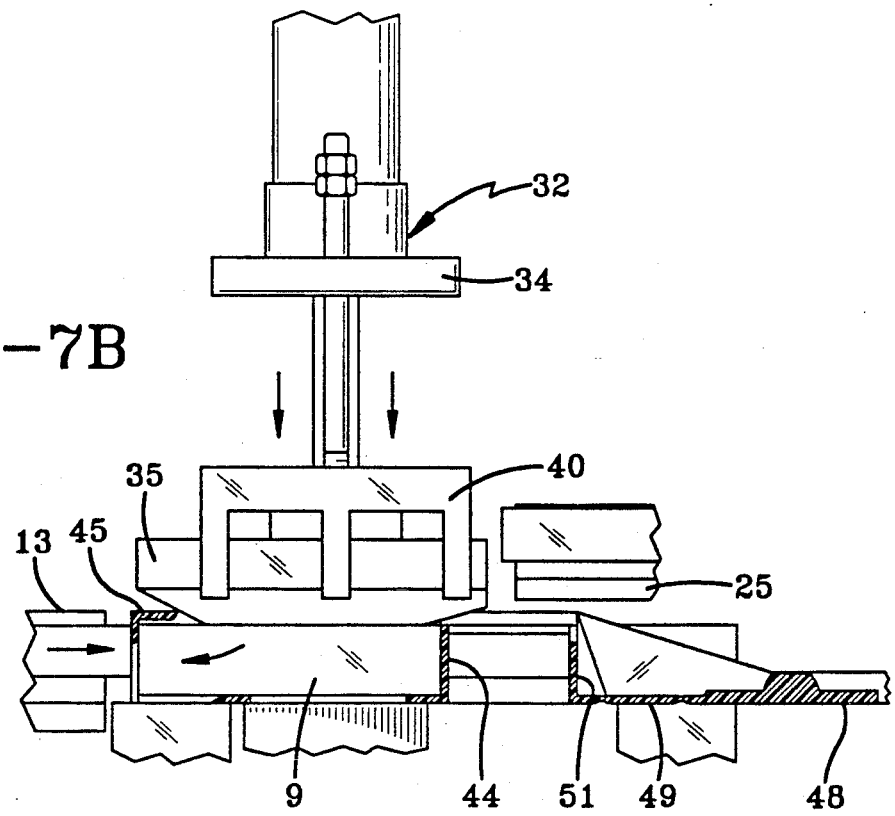
Figure 8:
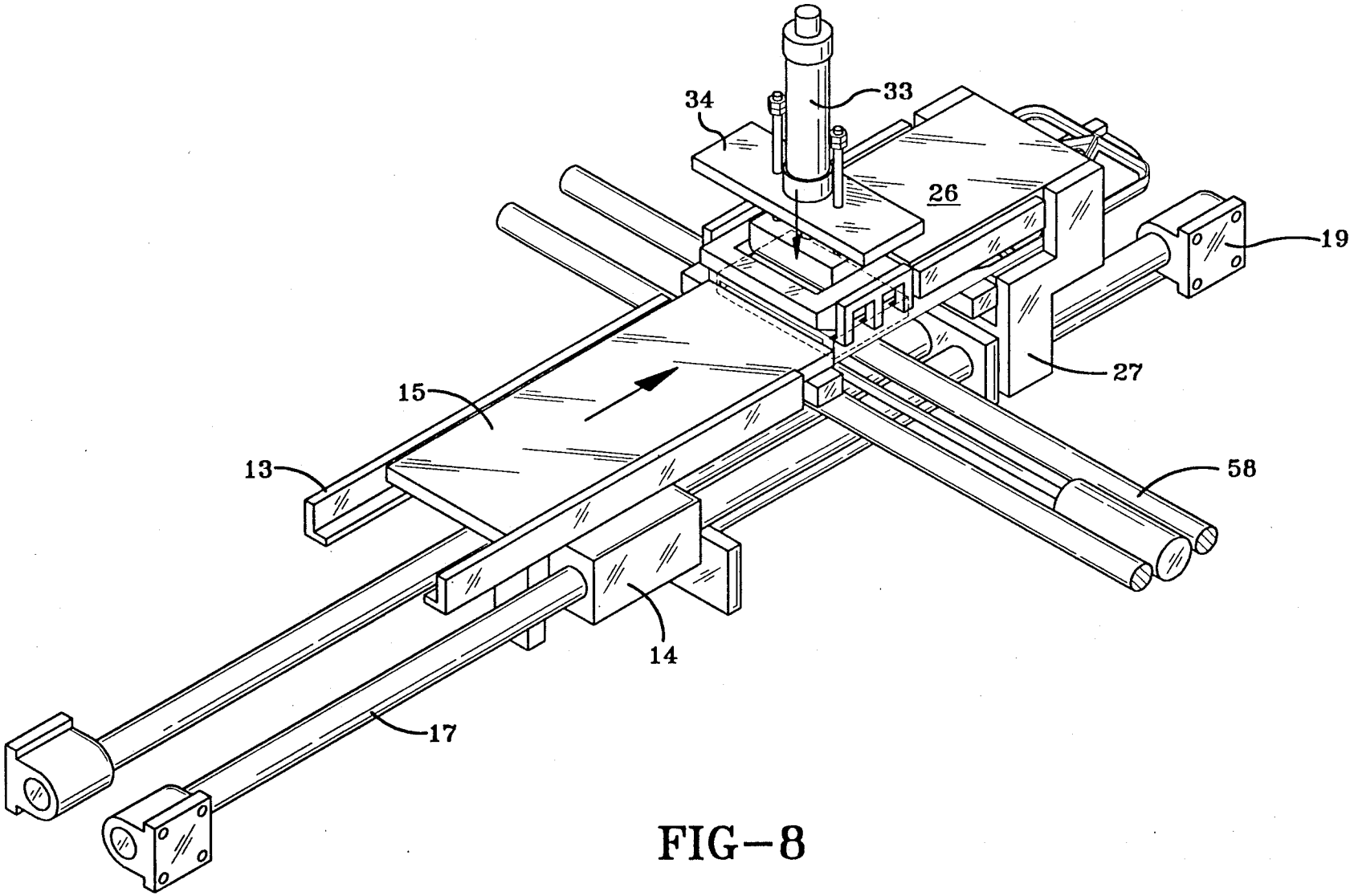
FIG. 8 is a perspective view similar to FIGS. 5–7 showing the cassette being completely seated within the storage compartment of the security package as shown diagrammatically in FIGS. 7A and 7B.

As shown in FIGS. 7, 7A and 7B, load cylinder 33 is actuated as slide plate 15 continues to move package 8 in the direction of arrow A toward load station 18. Upon the forward end 43 of cassette 9 becoming over center of a rear wall 44 of the storage compartment, pressure plate 35 will move end 43 angularly into storage compartment 41 (FIG. 7A) through top access opening 42. Slide plate 15 continues to move package 8 in the direction of arrow A which moves front end 43 beneath a top retaining flange 45 of package 8 whereupon the continued downward pressure exerted by pivotally mounted plate 35 of load cylinder 33, will force rear end 46 of cassette 9 completely into storage compartment 41 as shown in FIG. 7B, as rear wall 44 of the storage compartment moves beyond rear end 46 of cassette 9. This action firmly seats cassette 9 within storage compartment 41, afterwhich the forward movement of slide plate 15 and package 8 is stopped by appropriate detection and control mechanisms (not shown) all of which are well known in the machine control art. Slide plates 15 and 26 are then returned to their pickup position beneath supply magazines 6 and 7 to restart the next loading sequence just described above.

Figure 4:
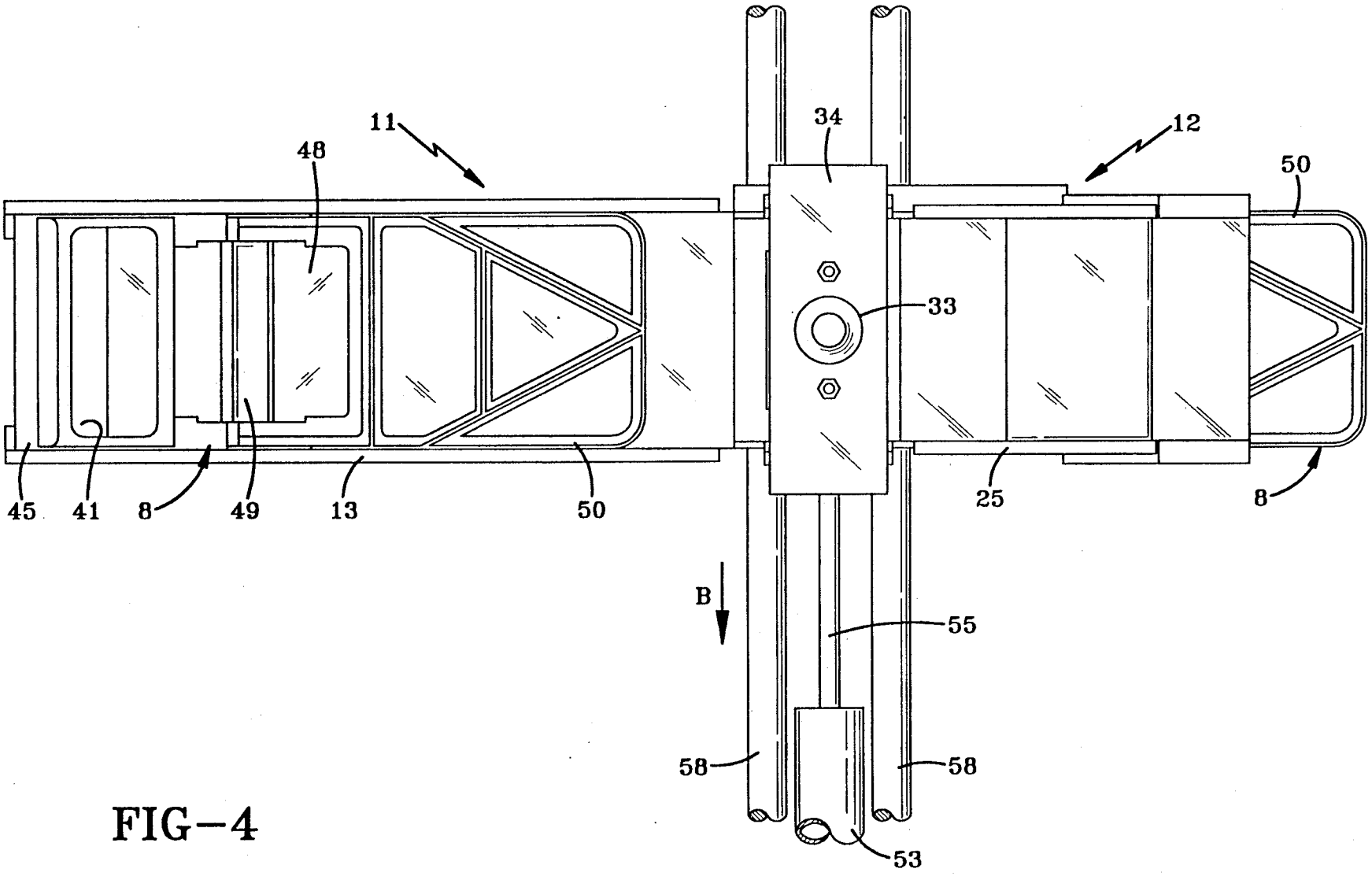
FIG. 4 is a fragmentary top plan view of the load station as shown in FIG. 3 with the supply magazines removed.
Figure 5:
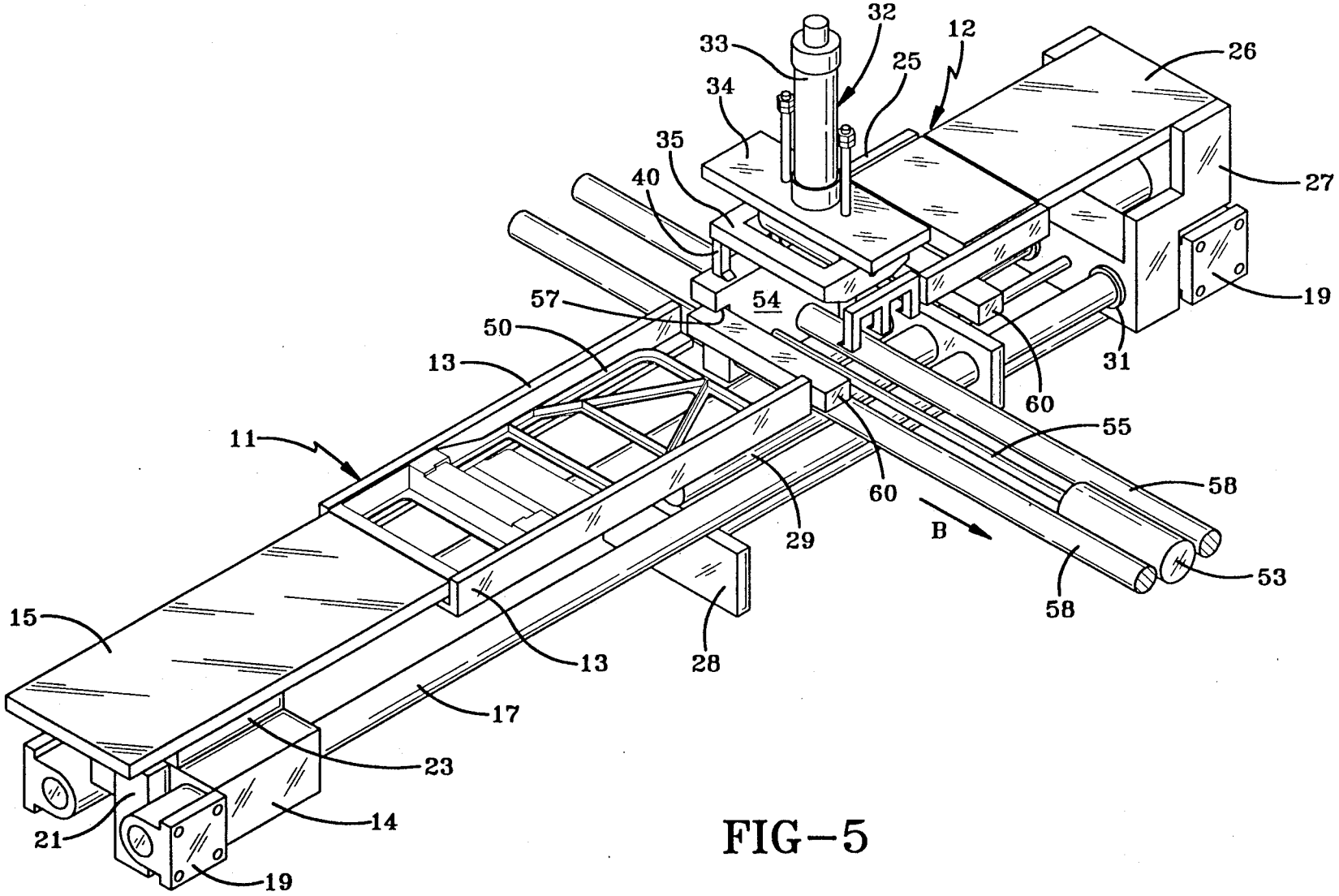
FIG. 5 is an enlarged diagrammatic perspective view of the load station and associated components of FIGS. 3 and 4, showing a package and cassette just before entering the load station.
Figure 6:
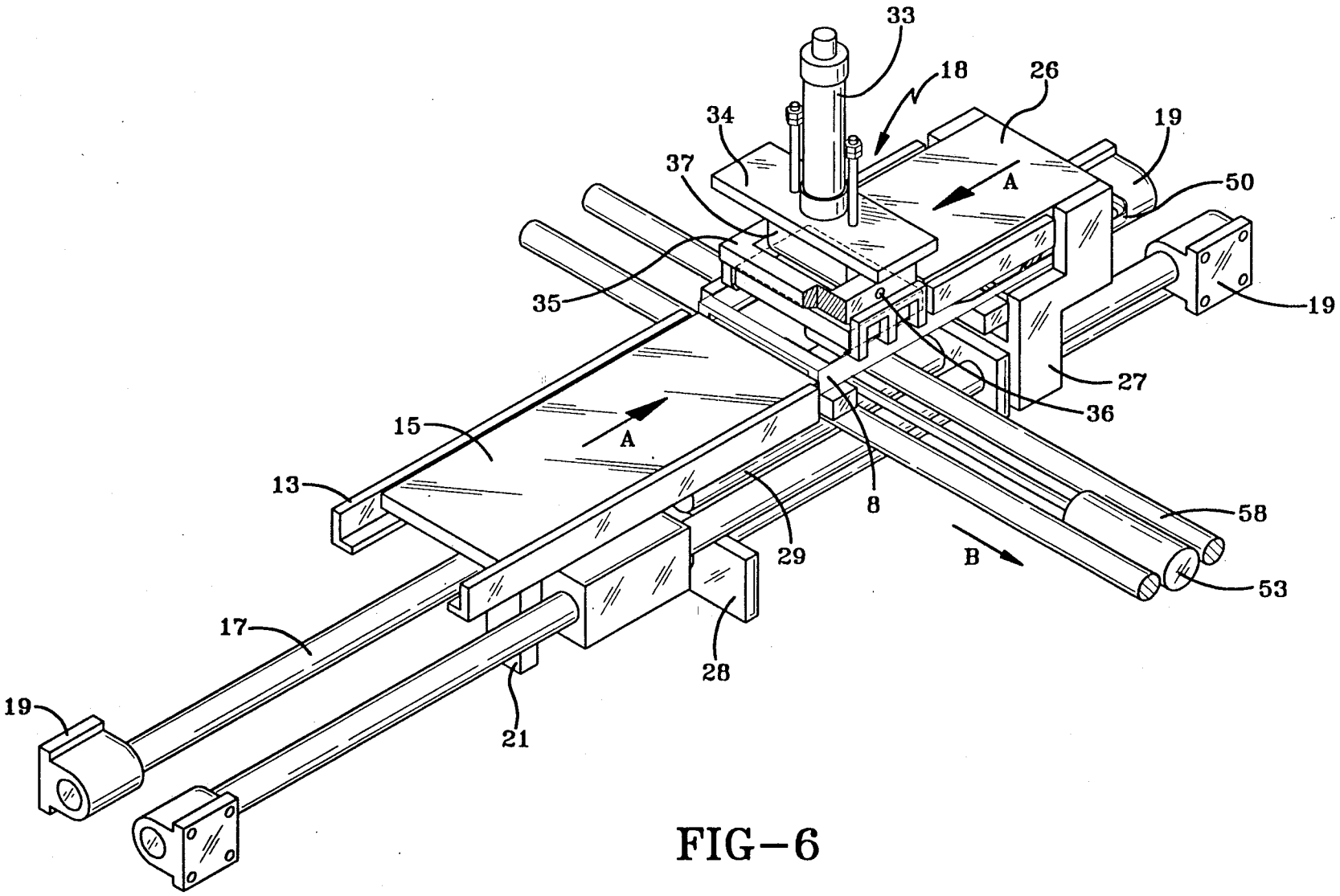
FIG. 6 is a perspective view similar to FIG. 5, showing the cassette and security package at the load station.

When in the loaded position of FIG. 7B, a hingedly mounted lock or slide plate 48 (FIG. 4), which is hingedly mounted by a double living hinge 49 to a wall 51 of security package 8 will be in its complete unfolded position as shown in FIG. 4 within the sidewall members which form a hanger portion 50 of package 8, the components of which are more fully described in the previous reference U.S. Pat. No. 4,834,238.

Next, the loaded security package 8 is removed from load station 18 to a lock station indicated generally at 52, by a pressure actuated cylinder 53 and a pusher plate 54 which is connected thereto by piston rod 55. Piston rod 55 will be in an extended position as shown particularly in FIGS. 4–8 generally beneath one of the flexible fingers, while cassette 9 is being loaded into storage compartment 41 of package 8. Upon actuation of cylinder 53, plate 54 will move the loaded package in the direction of arrows B in FIGS. 4–6 upon the retraction of piston rod 55. Pusher plate 54 preferably has a pair of cutouts 57 (FIG. 5) which enables it to slide past a pair of stationary slide bars 60 mounted at the load station. Plate 54 will move the loaded package in a transverse direction from that of the direction in which the slide plates move the cassette and package toward the load station. Plate 54 is slidably mounted by bearings (not shown) on a pair of stationary spaced slide rods 58 and delivers the loaded package onto a support table 59 (FIG. 9–11) or other type of supporting mechanism for slidably receiving the loaded cassette thereon. Support table 59 preferably is inclined rearwardly toward the load station as shown particularly in FIG. 2, to ensure that the loaded packages remain in general abutting relationship with each other due to the force of gravity acting thereon as shown in FIG. 11.

Figure 11:
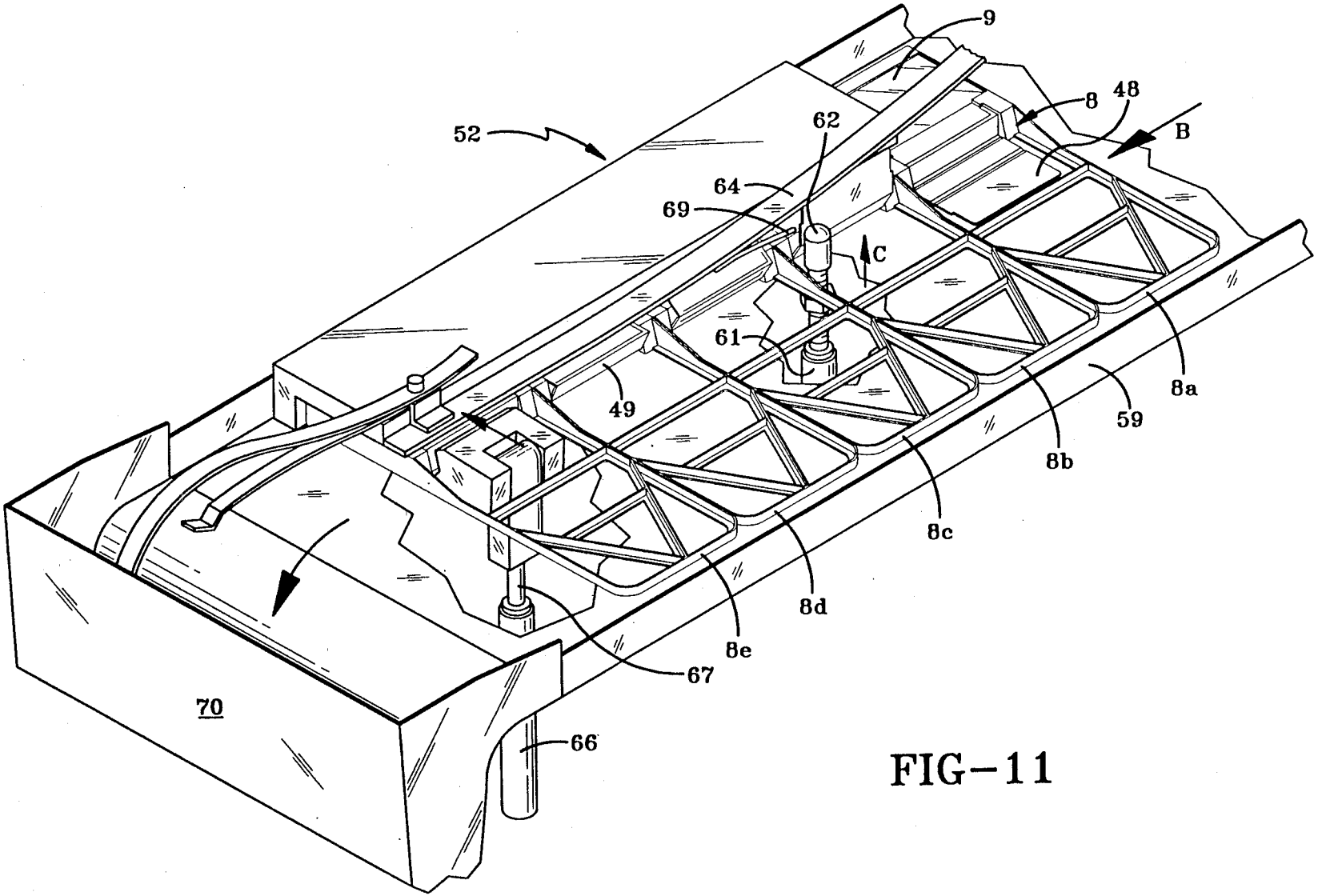
FIG. 11 is an enlarged diagrammatic perspective view showing movement of a plurality of loaded cassettes through the lock station wherein the locking plate of the package is moved from an unfolded position to a completely locked position.
Figure 12:
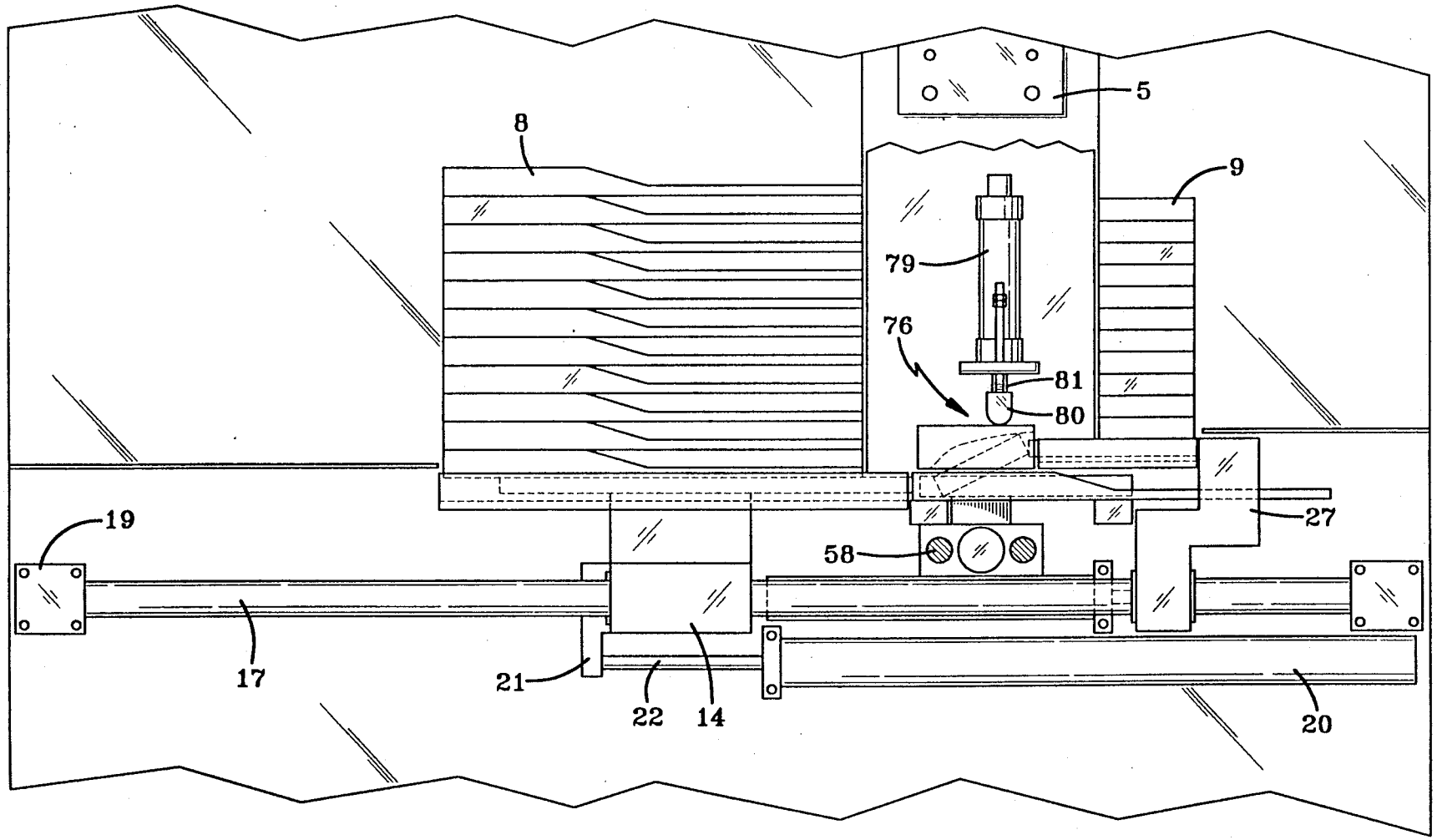
FIG. 12 is a fragmentary front elevational view similar to FIG. 3 showing a modified load station of the loading machine.
Figure 13:
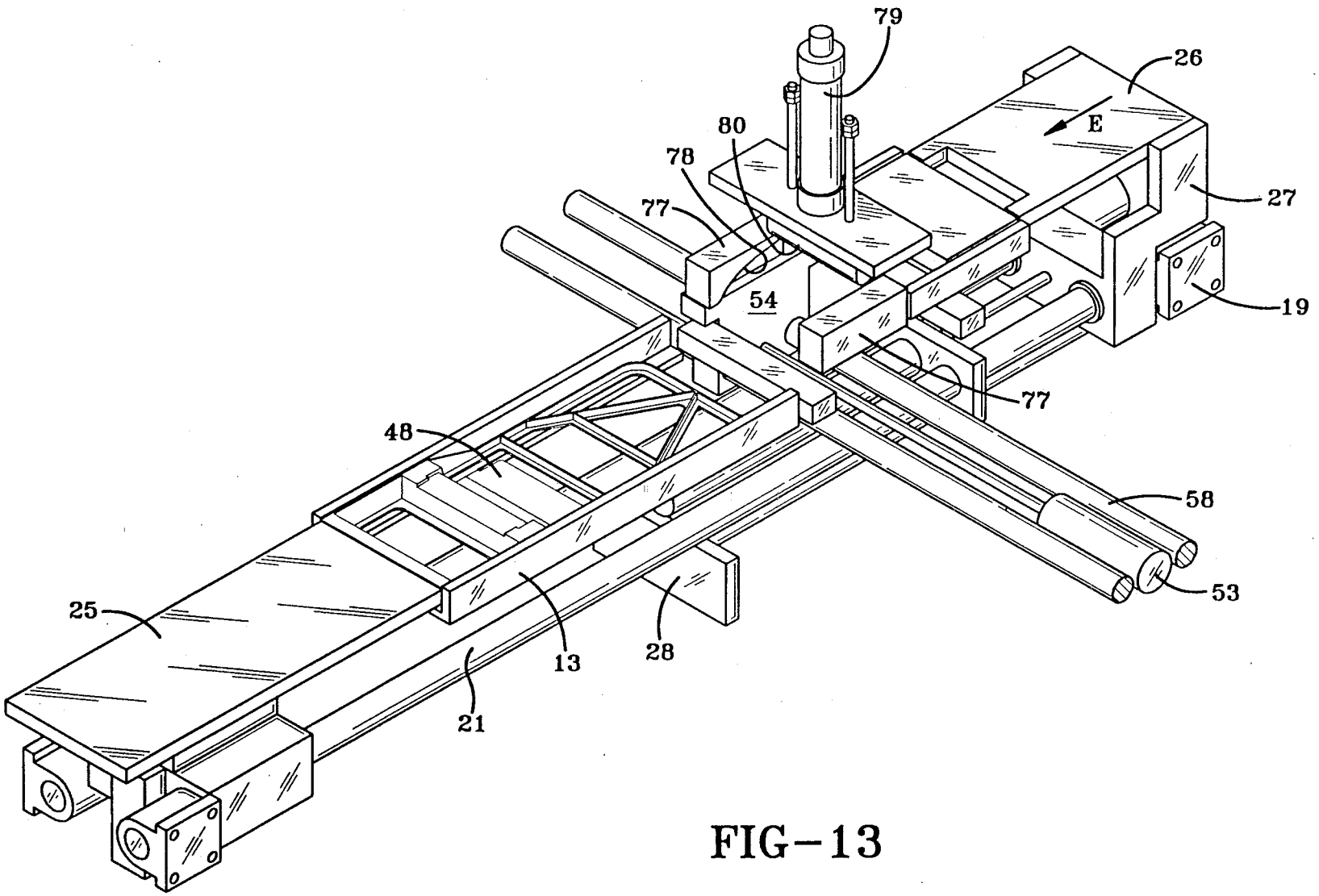
FIG. 13 is a fragmentary perspective view showing the modified load station of FIG. 12 and a security package and cassette just prior to being moved into the load position.
Figure 14:
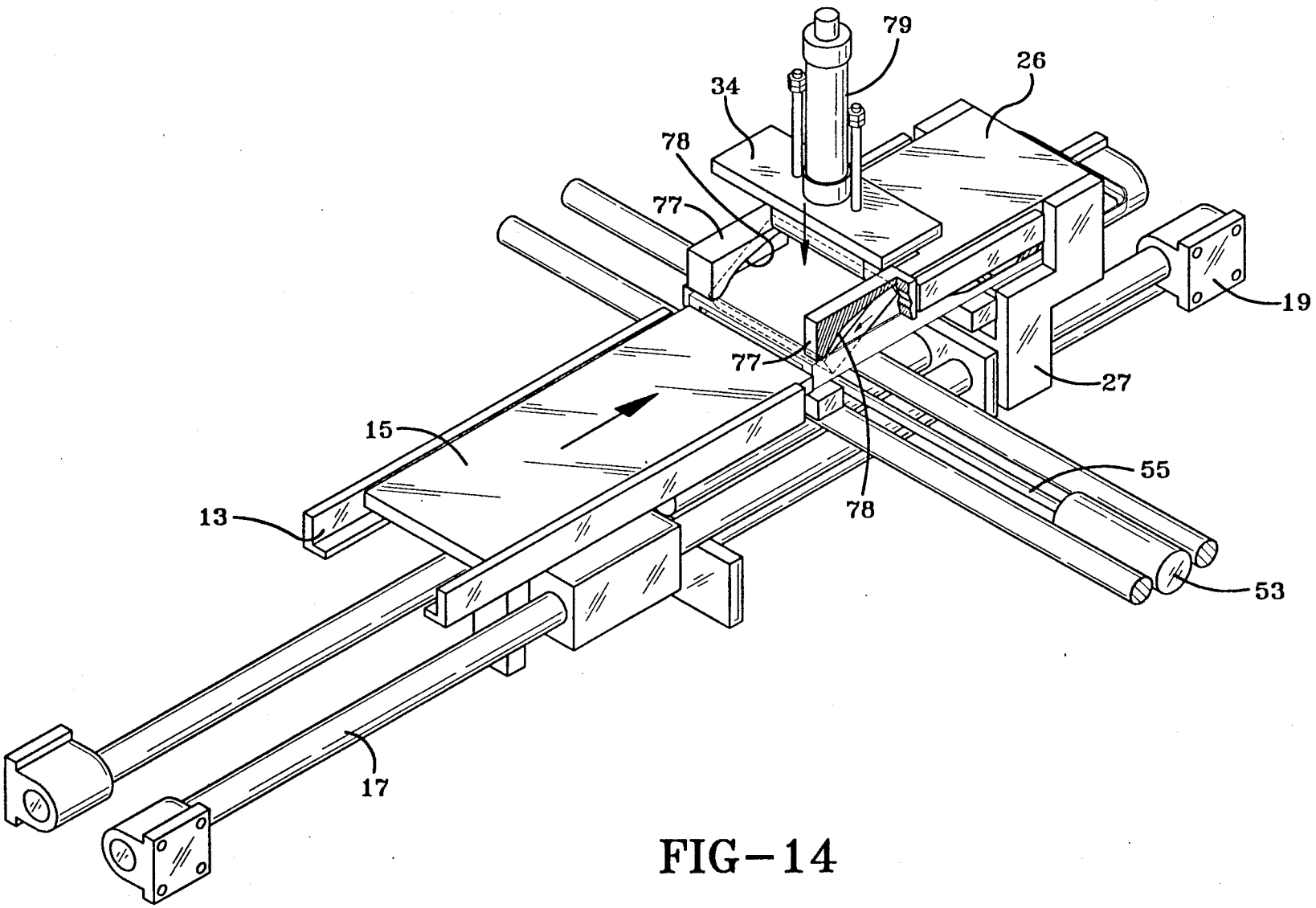
FIG. 14 is a perspective view similar to FIG. 13 with portions broken away and in section, showing the security package at the load station and a cassette being loaded therein.
Figure 15:
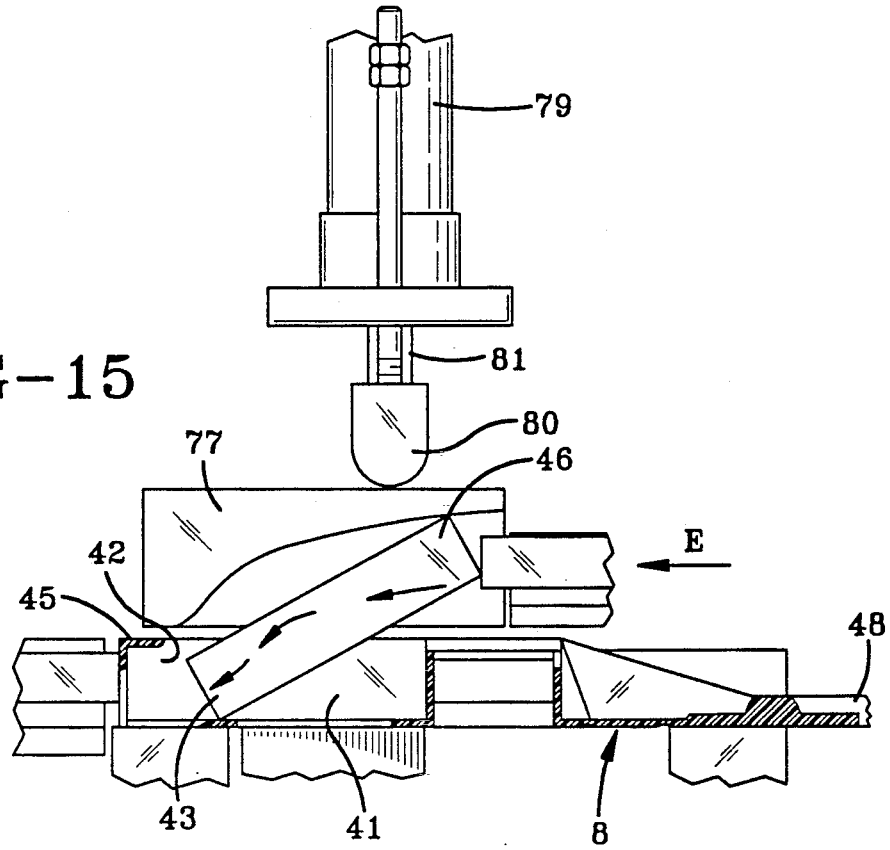
FIG. 15 is a diagrammatic side elevational view showing a cassette entering into the storage compartment of the security package.

As shown in FIG. 11, a series of loaded packages 8 will be moving along support table 59 due to the action of pusher plate 54 removing the most recently loaded package from the load station. FIG. 11 shows the series of operations performed on lock plate 48 at the lock station to move it from its fully unfolded position as represented by package 8*a*, to the fully locked position designated by security package 8*e*. Upon package 8*a* moving along support table 59 to the position 8*b*, a pressure cylinder 61 is actuated moving its plunger 62 upwardly in the direction of arrow C which engages unfolded plate 48 pivoting it upwardly to a partially folded position beneath a ramped guide track 64. As package 8 continues to move in the direction of Arrow B, partially folded lock plate 48 will move under and along guide track 64 assisted initially by guide finger 69, which will move plate 48 represented by package 8*b* into the latch position represented by package 8*d*, in which position the various slide latching projections (not shown) are received in associated slide channels to retain plate 48 in the latch position as is fully described in U.S. Pat. No. 4,834,238.

Next, another pressure actuated cylinder 66 (FIGS. 9–11) is actuated moving its piston rod 67 upwardly causing a pivotally mounted cam plate 68 to engage double hinge 49 of lock plate 48. Cam 68 moves plate 48 from its latch position of package 8*d*, to the fully locked position shown by package 8*e*, in which slide plate 48 extends partially over top access opening 42 of storage compartment 41 to lock the cassette securely therein.

Continued forward movement of the next loaded package onto support table 59 will advance each of the loaded packages to the next position whereupon the most advanced fully locked package 8*e* is discharged into a rollover trough 70 where it is received onto a discharge table 71 (FIGS. 9 and 10) where the packages are moved in the direction of arrow D by a discharge mechanism indicated generally at 65. Mechanism 65 includes a pusher rod 72 which is coordinated with the movement of pusher plate 54 at the load stations to provide proper indexing of the packages being locked and being removed along discharge table 71 for subsequent package and shipment. Rearward movement of pusher rod 72 from the position of FIG. 10 to the position of FIG. 9, will advance a pusher plate 73 to move the packages along table 71 and upon retraction to the position of FIG. 10 will enable another loaded and locked package 8*e* to be moved into position for subsequent forward movement in the direction of arrow D.

A modified form of the loading machine is indicated generally at 75 and is shown particularly in FIGS. 12–21. Magazine supplies 6 and 7 and slide assemblies 11 and 12 are the same for machine 75 as for machine 1 described above, and therefore are not described in further detail. The main difference in the second embodiment of machine 75 with respect to machine 1 is the particular construction of the load mechanism. This load mechanism is indicated generally at 76, and includes a pair of spaced cam blocks 77 which have downwardly curved cam shoulders 78 which replace flexible fingers 40 discussed above. A pressure actuated cylinder 79 is mounted above cam block 77 and has a curved pusher pad 80 mounted on the extended end of a piston rod 81.

Figure 16:
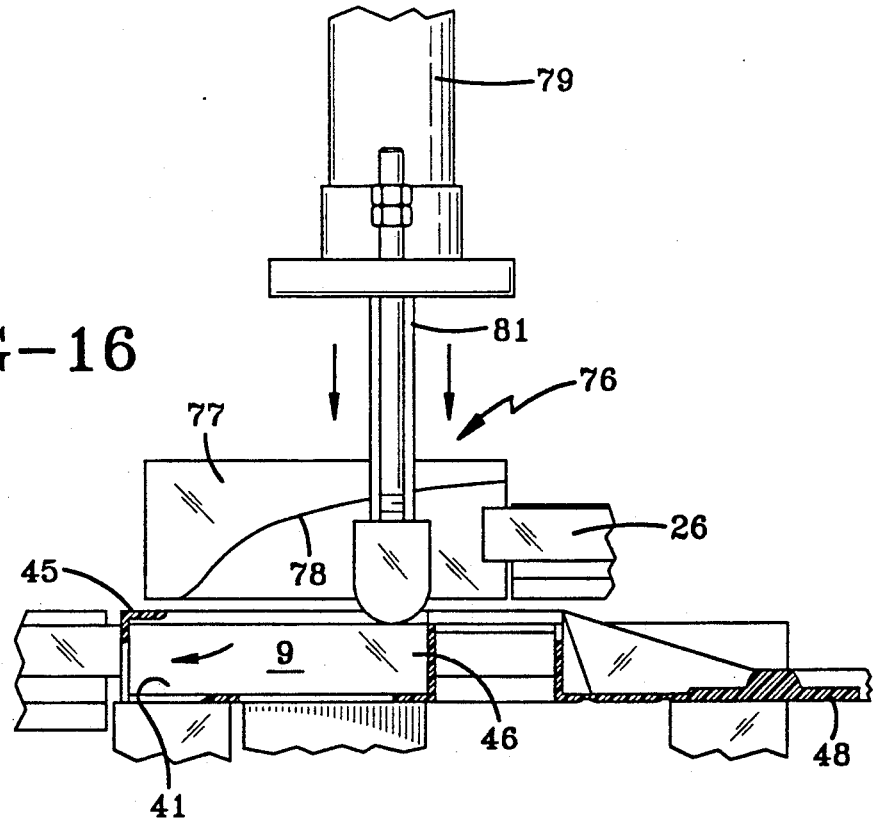
FIG. 16 is a diagrammatic side elevational view similar to FIG. 15 showing the cassette being fully seated into the storage compartment of the security package.

Upon an unloaded security package 8 reaching the end of its stroke at the load station, it will be in a stationary position beneath load mechanism 76. Slide plate 26 of cassette slide assembly 12 will continue to move forwardly in the direction of arrow E (FIG. 15) which will move the forward end 43 of cassette 9 along cam shoulders 78, causing end 43 to enter storage compartment 41 angularly through top access opening 42 and partially beneath top retaining flange 45 of package 8. Upon reaching this position, cylinder 79 is actuated whereupon pusher pad 80 engages rear end 46 of cassette 9 forcing it completely into storage compartment 41 and moving forward end 43 thereof completely beneath top retaining flange 45 to completely seat the cassette within the storage compartment as shown in FIG. 16.

After loading cassette 9 into package 8, lock plate 48 will still be in its fully unfolded position as described previously. Cylinder 53 is then actuated removing the loaded package and cassette from the load station by pusher plate 54 described above, bringing the loaded cassette into a lock station 83 wherein a modified locking sequence is performed on the loaded package as shown in FIGS. 17–21 to move the unfolded lock plate to the completely locked position.

Figure 17:
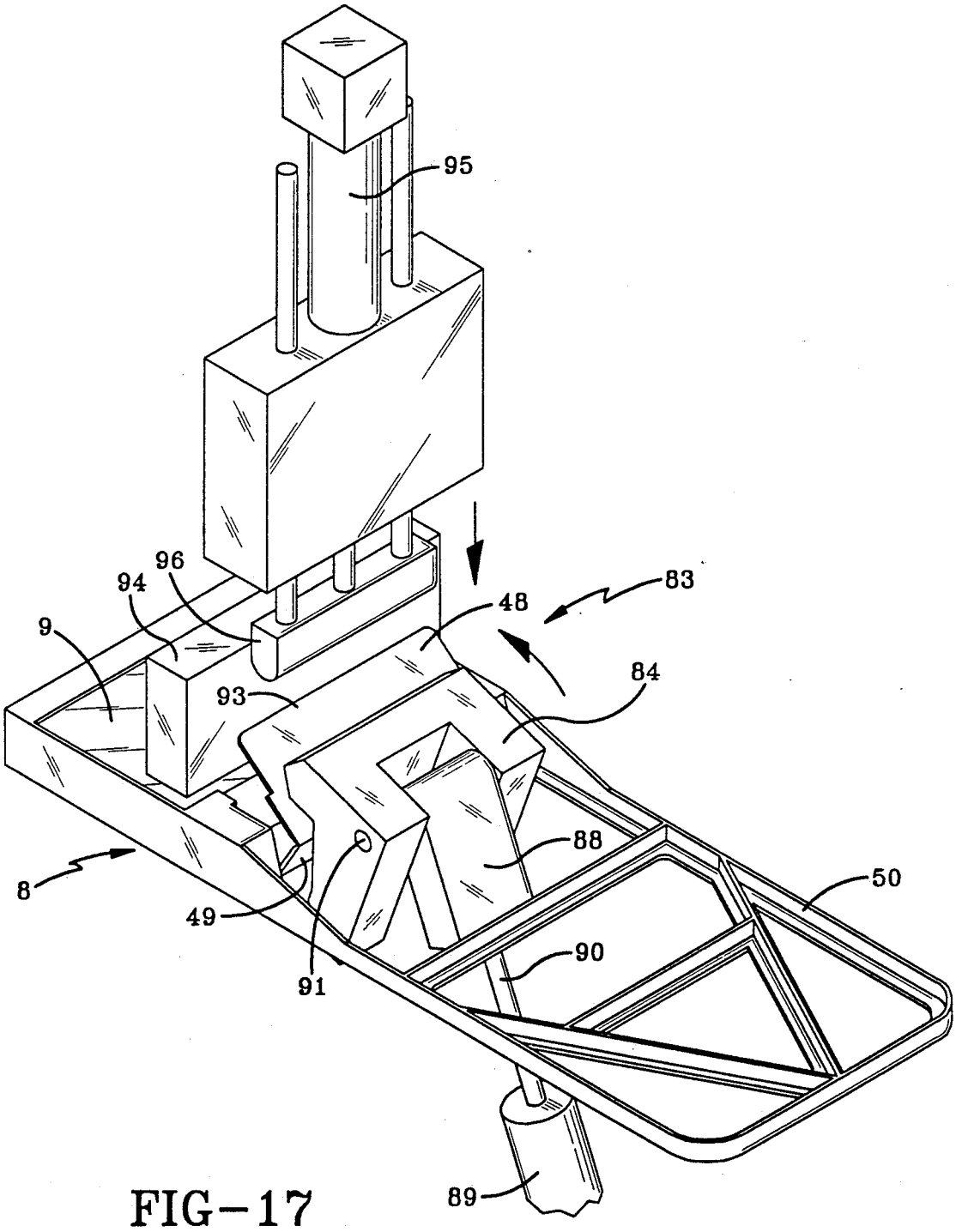
FIG. 17 is an enlarged fragmentary perspective view showing the lock plate of the security package being moved toward latched position at the lock station.
Figure 18:
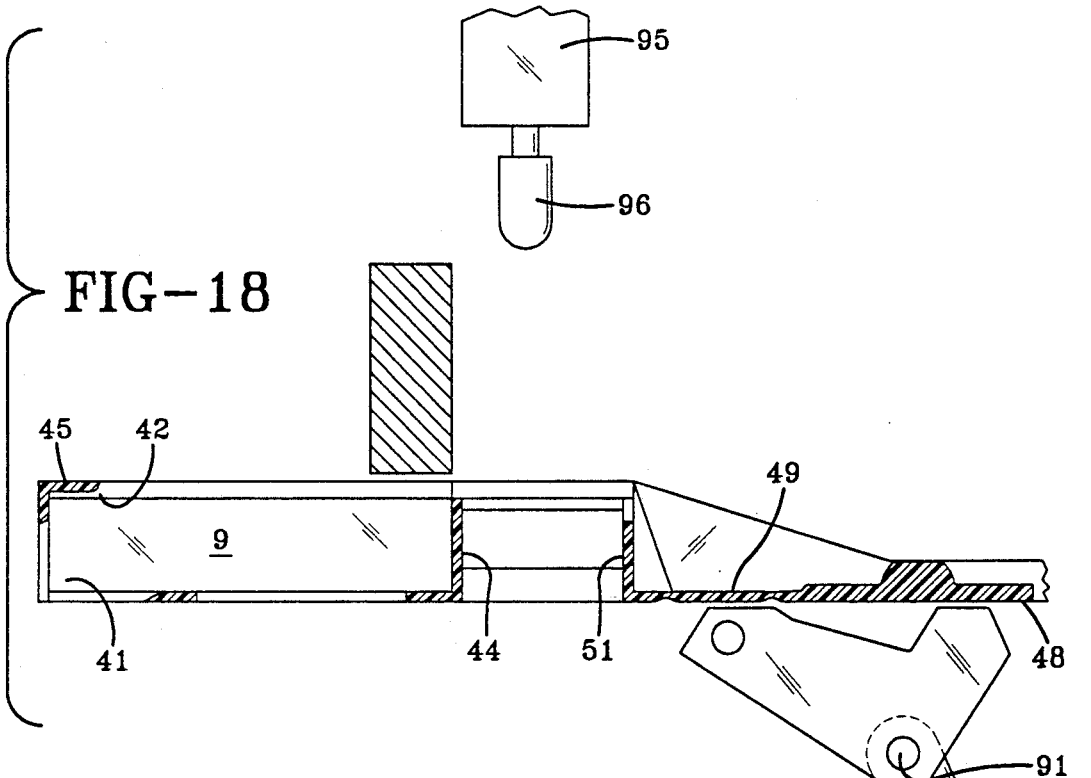
FIGS. 18–21 is a series of diagrammatic sectional views showing movement of the lock plate from its fully unfolded position into its lock position.
Figure 19:
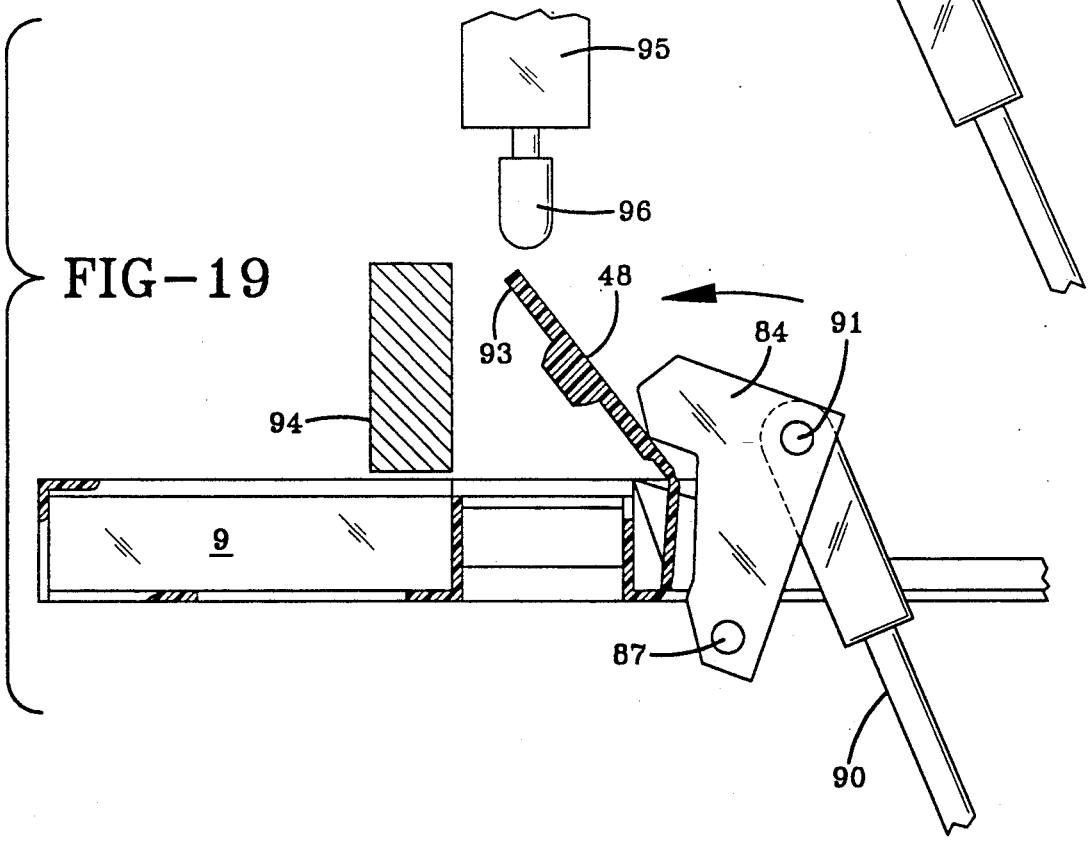

Upon loaded package 8*a* reaching a predetermined position at lock station 83, a cam 84 which is pivotally mounted by a fixed pin 87, is actuated through a pressure actuated cylinder 89. Piston rod 90 is connected to a pivot block 88 which is pivotally attached to cam 84 by a pivot pin 91. Cam 84 will move lock plate 48 from its generally flat, unfolded position to a partially folded position as shown in FIGS. 17–19, at which position the extended end 93 of lock plate 48 engages a guide block 94. Another power actuated cylinder 95 then moves plunger 96 downwardly in the direction of Arrow F (FIG. 20) which moves lock plate 48 into the latched position of FIG. 20 with plate end 93 sliding downwardly along guide block 94.

Figure 20:
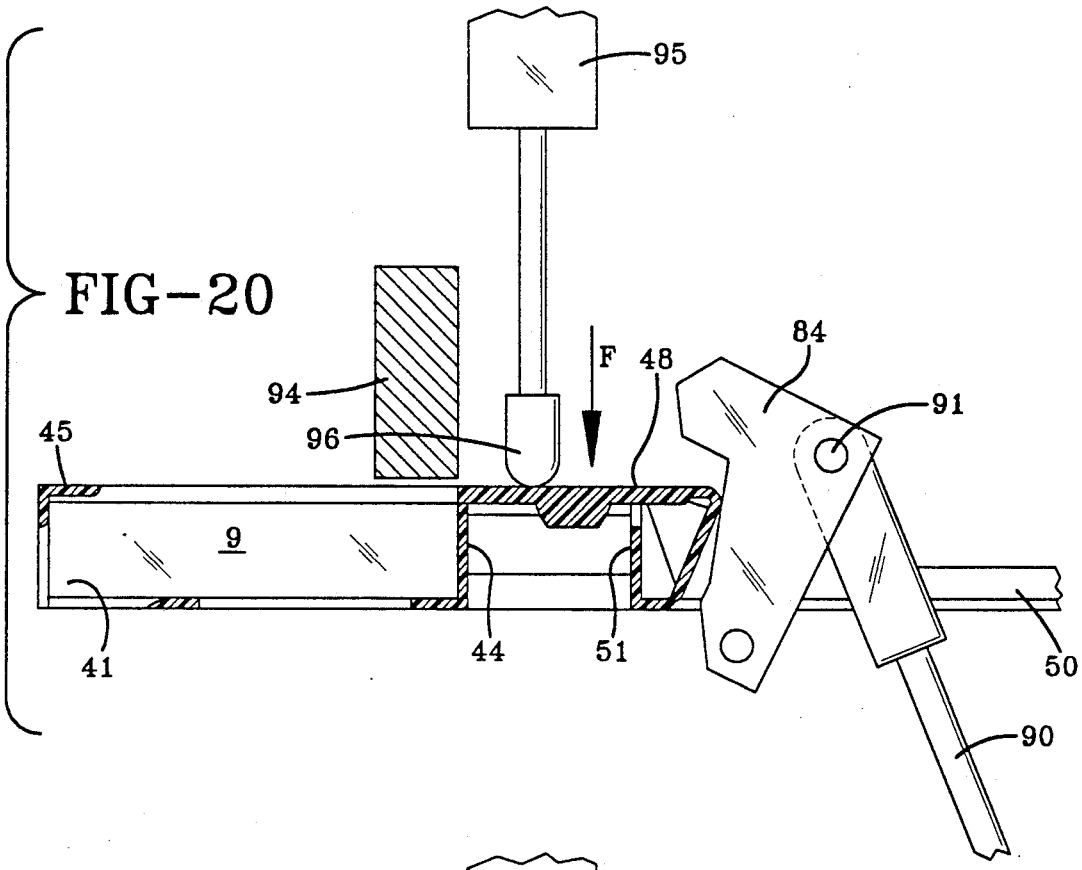
Figure 21:
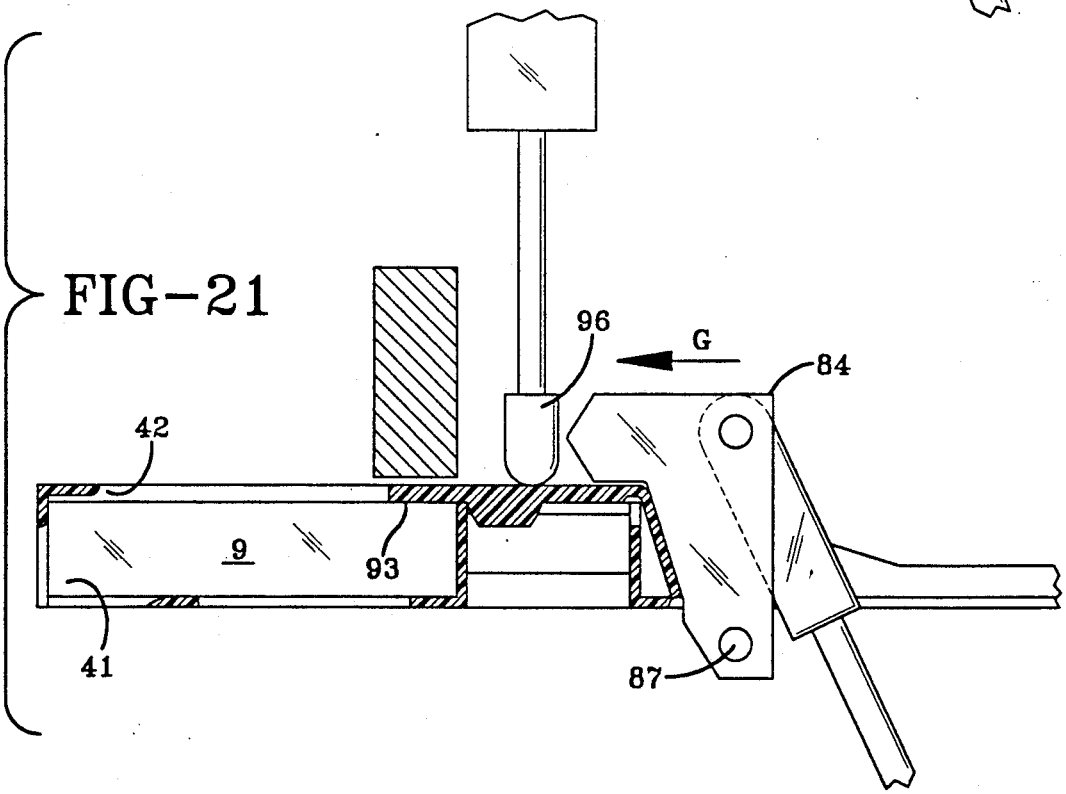

Next cylinder 89 is reactuated and cam 84 due to its pivotal mounting on pivot block 88, will move latched lock plate 48 forwardly in the direction of arrow G from its latch position of FIG. 20 to the locked position of FIG. 21 wherein extended end 93 of lock plate 48 extends over the storage compartment access opening 42 to fully retain the cassette in compartment 41. The fully loaded and locked package then is moved to a discharge station by the continued movement of the series of cassettes for subsequent pickup and packaging, either by a mechanism as shown in FIGS. 9 and 10 or a different discharge arrangement.

Accordingly, the improved loading machine of the present invention enables a plurality of cassettes to be sequentially loaded into the storage compartments of a plurality of security packages automatically, followed by the automatic movement and locking of a lock plate to a fully locked position in a continuous procedure. The loaded packages then will move through the lock station where power actuated cams will move the lock plate from an unfolded flat position to a latched position and then to a fully locked position. It is readily seen that should the lock plate have a different arrangement than that shown above, such as shown in U.S. Pat. No. 4,865,190 wherein the lock plate is moved directly from an unfolded position to a fully locked position without first being in a latched position, that such security packages could easily be incorporated into machines 1 and 75 by a simple redesign of the locking steps and power actuated cams without affecting the concept of the invention.

Loading machine 75 has one advantage over that of machine in that it does not require the simultaneous coordinated movements of the security package and cassette to load the cassette within the storage compartment as in machine 1. In machine 75, the security package reaches its fully extended stopped position afterwhich the cassette is moved forwardly causing it to follow the curved cam shoulders directly into the stationary security package, followed by the subsequent actuation of pusher pad cylinder 79 to fully seat the cassette within the storage compartment. This provides less complicated control coordination than that of machine 1.

The various pressure actuated cylinders of machines 1 and 75 preferably are pneumatic and could be powered by various other means if desired without affecting the concept of the invention. Furthermore, the various slide assemblies may have other constructions in order to move the packages and cassettes from their storage magazines to the load stations as well as the mechanism for removing a loaded package from the load station to the locking station. However, the particular mechanisms shown in the drawings and described above are believed to best achieve the desired objectives and advantages of the present invention. Likewise, the various controls may be by a programmable controller or other type of logic systems and various limit switches and detection mechanisms all of which are well known in the art and therefore are not described in further detail.

Also, it is readily understood that the term cassette as used throughout may include other types of recorded medium such as video tapes, compact discs etc. without effecting the concept of the invention.

Accordingly, the improved machine and method for loading a cassette into a security package is simplified, provides an effective, safe, inexpensive, and efficient device which achieves all the enumerated objectives, provide for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved machine and method is constructed and used, the characteristics of the construction, and the advantageous, new and useful results obtained; the new and useful structures, devices, elements, arrangements, parts and combinations, are set forth in the appended claims.

We claim:

1. A machine for automatically loading a cassette into a security package of the type having a storage compartment and an access opening providing access into said compartment, and further having a lock plate, of the type which has a living hinge integrally molded therewith, movable over the access opening and into a locked position to block removal of the cassette from the storage compartment; said machine including:

a) a load station;

b) first means for moving a security package from a supply of said packages to the load station;

c) second means for moving a cassette from a supply of said cassettes to the load station;

d) load means for initially moving a first end of the cassette in an angular direction with respect to the security package through the access opening of the package and partially into the storage compartment, and then subsequently moving a second end of the cassette into the storage compartment while the security package is still located at said load station to fully seat the cassette therein; and e) a lock station which includes a first pressure actuated cam for moving the lock plate from an unfolded position to a partially folded position by operating said living hinge of said lock plate, and a second pressure actuated cam for moving the lock plate from the partially folded position to a latched position, said first pressure actuated cam also being used to move said lock plate from said latched position to a locked position.

2. The machine defined in claim 1 in which the first and second means each includes slide channels along which the respective package and cassette is moved to the load station, and a power actuated slide plate engageable with each of the package and cassette for respectively moving said package and cassette along their respective slide channels.

3. The machine defined in claim 2 in which a pressure actuated cylinder operatively engages each of the slide plates for moving said slide plates and package and cassette from the supply of said packages and cassettes to the load station.

4. The machine defined in claim 3 in which the slide channels each extend in a generally horizontal plane; and in which the plane of the package slide channels is spaced below the plane of the cassette slide channels.

5. The machine defined in claim 4 in which the load means includes a pressure actuated plunger mounted at the load station above the plane of the slide channels; and in which the load means plunger engages a cassette to move said cassette into the storage compartment of the security package.

6. The machine defined in claim 1 in which the load means includes spaced apart plates and a pressure actuated plunger moveable between said spaced apart plates; in which the plates move the first end of the cassette into the storage compartment; and in which the plunger moves the second end of the cassette into the storage compartment.

7. The machined defined in claim 1 in which the lock station includes a pressure actuated slide means for moving the package and the stored cassette from the load station to the lock station.

8. The machine defined in claim 1 in which the supply of security packages and the supply of cassettes are vertical stacks of said packages and cassettes located above the first means and the second means, respectively.

9. A method of loading a cassette into a security package of the type having a storage compartment and a lock plate for blocking removal of the cassette from the storage compartment, said method including the steps of:

a) moving a security package from a supply of said packages toward a load station, b) moving a cassette from a supply of said cassettes toward the load station;

c) moving a first end of the cassette through an access opening of the storage compartment and partially into the storage compartment;

d) moving a second end of the cassette into the storage compartment to fully seat the cassette therein;

e) moving the lock plate from an unfolded position to a partially folded position, by operating a pressure actuated cam a first time to operate on at least one living hinge which connects the lock plate to the security package; actuating a plunger to move the lock plate from a partially folded position, to a fully folded latched position; and by actuating said pressure actuated cam a second time to move said lock plate from a latched position to a locked position.

10. The method defined in claim 9 including moving the first end of the cassette along spaced apart cam surfaces in a downwardly inclined direction toward the package when moving said first end partially into the storage compartment, and then moving the second end of the cassette in a vertical downward direction by actuating a plunger moveable between said spaced apart cam surfaces when moving said second end into the storage compartment.

11. The method defined in claim 9 including continuing to move the package toward the load station simultaneously with exerting a downward force on the cassette when moving the second end of the cassette into the storage compartment.

12. The method defined in claim 9 including locating the supplies of the security packages and cassettes on opposite sides of the load station, and then moving said security packages and cassettes in generally horizontal directions simultaneously toward each other and into an overlapping relationship when at the load station.

13. The method as defined in claim 12 including moving the security package and loaded cassette from the load station to a lock station in a direction transverse to the direction of movement of the package and cassette when moving to the load station.

14. A method of loading a cassette into a security package of the type having a storage compartment and a lock plate for blocking removal of the cassette from the storage compartment, said method including the steps of:

(a) moving a security package from a supply of said packages toward a load station;
(b) moving a cassette from a supply of said cassettes toward the load station;
(c) moving a first end of the cassette through an access opening of the storage compartment and partially into the storage compartment;
(d) moving a second end of the cassette into the storage compartment to fully seat the cassette therein;
(e) actuating a plunger to move the lock plate to a partially folded position;
(f) moving the partial folded lock plate along a guide track to move the lock plate from the partially folded position to a latched position; and
(g) actuating a cam to move the lock plate from the latched position to a locked position thereby securing the cassette within the storage compartment.

15. A machine for automatically loading a cassette into a security package of the type having a storage compartment and an access opening providing access into said compartment, and further having a lock plate movable over the access opening and into a locked position to block removal of the cassette from the storage compartment; said machine including:
(a) a load station;
(b) first means for moving a security package from a supply of said packages to the load station;
(c) second means for moving a cassette from a supply of said cassettes to the load station;
(d) a pressure actuated plunger having a pivotally mounted pad on an extended end of said plunger, in which said pad moves a first end of the cassette in an angular direction with respect to the security package, into the storage compartment, and then subsequently moves a second end of the cassette completely into the storage compartment upon continued movement of the said security package at the load station by the first means to thereby fully seat the cassette therein; and
(e) lock means for moving the lock plate into the locked position over at least a part of the access opening.

16. The machine defined in claim 15 in which a plurality of flexible fingers are located at the load station and suspends the cassette at the load station after delivery thereto by the second means until the cassette is moved by the plunger and pad into the storage compartment of the security package.

17. A machine for automatically loading a cassette into a security package of the type having a storage compartment and an access opening providing access into said compartment, and further having a lock plate movable over the access opening and into a locked position to block removal of the cassette from the storage compartment; said machine including:
(a) a load station;
(b) first means for moving a security package from a supply of said packages to the load station;
(c) second means for moving a cassette from a supply of said cassettes to the load station;
(d) load means for initially moving a first end of the cassette in an angular direction with respect to the security package through the access opening of the package and partially into the storage compartment, and then subsequently moving a second end of the cassette into the storage compartment to fully seat the cassette therein;
(e) a pressure actuated plunger for moving the lock plate initially from an unfolded position to a partially folded position;
(f) a guide track for moving the partially folded lock plate to a latched position; and
(g) a pressure actuated cam for moving the lock plate from the latched position to the locked position.

18. A method of loading a cassette into a security package of the type having a storage compartment and a lock plate for blocking removal of the cassette from the storage compartment, said method including the steps of:
a) moving a security package from a supply of said packages toward a load station;
b) moving a cassette from a supply of said cassettes toward the load station;
c) moving a first end of a cassette through an access opening of the storage compartment into the storage compartment while said cassette and security package are still at the load station; and
d) moving a second end of the cassette into the storage compartment to fully seat the cassette therein while said cassette and security package are still a the load station.

19. A machine for automatically loading a cassette into a security package of the type having a storage compartment and access opening providing access into said compartment, and further having a lock plate movable over the access opening and into a locked position to block removal of the cassette from the storage compartment; said machine comprising:
a) a load station;
b) first means for moving a security package from a supply of said packages to the load station;
c) second means for moving a cassette from a supply of said cassettes to the load station;
d) load means located at said load station for initially moving a first end of the cassette in an angular direction with respect to the security package through the access opening of the package and partially into the storage compartment, and then subsequently moving a second end of the cassette into the storage compartment while the security package is still located at said load station to fully seat the cassette therein.

* * * * *